US008661695B2

(12) United States Patent
Hermansen et al.

(10) Patent No.: US 8,661,695 B2
(45) Date of Patent: Mar. 4, 2014

(54) GUIDE BAR

(75) Inventors: Roger Hermansen, Råholt (NO); John Flaten, Askim (NO); Lennart Ekrud, Huskvarna (SE); Terje Berget, Strömstad (SE)

(73) Assignee: Husqvarna AB, Huskvarna (SE)

( * ) Notice: Subject to any disclaimer, the term of this patent is extended or adjusted under 35 U.S.C. 154(b) by 965 days.

(21) Appl. No.: 10/495,888

(22) PCT Filed: Nov. 26, 2002

(86) PCT No.: PCT/SE02/02172

§ 371 (c)(1), (2), (4) Date: Mar. 3, 2005

(87) PCT Pub. No.: WO03/045644

PCT Pub. Date: Jun. 5, 2003

(65) Prior Publication Data

US 2005/0150118 A1 Jul. 14, 2005

(30) Foreign Application Priority Data

Nov. 26, 2001 (SE) ..... 0103948-6

(51) Int. Cl.
*B27B 17/02* (2006.01)

(52) U.S. Cl.
USPC ..... 30/383; 30/387; 83/830

(58) Field of Classification Search
USPC ..... 83/830–834; 30/381–387; 156/290–300
See application file for complete search history.

(56) References Cited

U.S. PATENT DOCUMENTS

| | | | | | |
|---|---|---|---|---|---|
| 3,473,581 | A | | 10/1969 | Merz | |
| 4,693,007 | A | * | 9/1987 | Apfel et al. | 30/387 |
| 4,961,263 | A | * | 10/1990 | Apfel et al. | 30/387 |
| 5,014,435 | A | * | 5/1991 | Date et al. | 30/387 |
| 5,067,243 | A | | 11/1991 | O'Neel | |
| 5,106,663 | A | * | 4/1992 | Box | 428/34 |
| 5,666,733 | A | | 9/1997 | Nitschmann | |

FOREIGN PATENT DOCUMENTS

| | | |
|---|---|---|
| DE | 19 43 917 | 3/1971 |
| RU | 2143970 | 1/2000 |
| SU | 2 019 731 C1 | 9/1991 |

OTHER PUBLICATIONS

L.I. Loppvok et al. Moscow, 1957, pp. 11-15.

* cited by examiner

*Primary Examiner* — Phong Nguyen
(74) *Attorney, Agent, or Firm* — Nelson Mullins Riley & Scarborough LLP

(57) ABSTRACT

The claimed invention relates to a device in a guide bar (10) for a chain saw. The guide bar (10) comprises at least two layers (11, 12, 13) that are bounded by an adhesive material. To ensure that the layer of adhesive material gets the optimal thickness is one of the surfaces of the layers that will be bounded to each other provided with several protruding parts (17). The protruding parts (17) will generate a slot, with the same width as the height of the protruding parts, for the adhesive material when the layers are put together. This is important to ensure maximum strength in the bounding as well as a constant width of a groove (14) for the saw chain.

9 Claims, 1 Drawing Sheet

GUIDE BAR

This application claims the benefit of International Application Number PCT/SE02/02172, which was published in English on June 5, 2003.

BACKGROUND OF THE INVENTION

The claimed invention relates to a device in a guide bar for a chain saw. The guide bar comprises at least two layers that are bounded together by an adhesive material.

Chain saws and other hand held tools have been under a high level of development during the last years. Great efforts have been done to improve the performance and the ergonomic features for the tools.

New materials and methods for manufacturing the different components have made it possible to reduce the weight of the tools. The tools are also stronger and more reliable which improves the working conditions for the operator considerably. Great achievements have been done with the machinery and casing, while the development of the guide bar have been struggling with several problems. The biggest problem is that since all new solutions for reducing the weight of the guide bar has ended in that the performance of the guide bar is deteriorated because of a reduced torsional and/or bending stiffness.

Guide bars normally comprises three layers. Layer one and three constitutes the outside of the guide bar. These two layers are normally made of the same material that most often is some kind of steel. Between layer one and three is layer two placed as an intermediate layer. This layer could be made of another material than layer one and three. The intermediate layer has a smaller length and width than layer one and three that are identically shaped so that a groove around the entire edge of the guide bar is defined between layer one and three. The saw chain is sliding in this groove.

Different types of saw chains require different grooves so the depth and the width of the groove are selected in order to meet the requirements. The width of the groove is changed by the thickness of the intermediate layer and the depth of the groove is related to the length and width of the intermediate layer.

The three layers are attached to each other by welding, normally spot welding or pressure welding. To make sure that the welding achieves enough strength and that no welding spark end up in the groove for the saw chain is the centre of the welding spot placed about 6 millimeters inside the edge of the intermediate layer, which is the same as the bottom surface of the groove. The distance from the centre of the welding spot to the edges of the groove is consequently 6 millimeters plus the depth of the groove. Because of this distance will the sides of the groove bend outwards when the saw chain is exposed to high load during use. The movements in the sides of the groove will make the saw chain move because of to much play in the groove. The movements in the saw chain are not good for the performance of the saw and will also increase the wear on both the guide bar and the saw chain.

The weight of the guide bar is an important parameter in order to facilitate and increase the efficiency of the work for the operator. Several different types of guide bars with an intermediate layer provided with holes of different sizes in order to reduce the weight of the tool are already known. A guide bar of this type is for example described in patent document DE4219956A1. These guide bars have a lower weight but the torsional and bending stiffness are reduced, which is bad for the performance of the guide bar.

Another alternative in order to reduce the weight of the guide bar is to use an intermediate layer in a material with low density like for example aluminium or a plastic material. These types of guide bars are described in patent document U.S. Pat. No. 4,693,007A. An intermediate layer in aluminium or a plastic material reduces the weight of the guide bar but the manufacturing of the guide bar get more complicated since the material in the intermediate layer not is suitable for welding. To solve this problem is the intermediate layer provided with recesses of a material suitable for welding placed where the welding spots will be placed. This type of guide bars is expensive to manufacture.

All the described types of guide bars are complicated which means that they are expensive to manufacture. The guide bars also have the drawback that the holes and the use of lighter materials to reduce the weight decreases torsional and bending stiffness of the guide bar which makes these solutions not satisfying.

There are also guide bars with recesses of a lighter material like aluminium or plastic in the outer layers, see for example U.S. Pat. No. 4,837,934A. However, this solution is also complicated to manufacture and the result is a guide bar with reduced torsional and bending stiffness. This solution is therefore not a good alternative to get a lighter guide bar.

All solutions to reduce the weight of the guide bar has resulted in a more complicated manufacturing process which makes the guide bars costly without improving the performance of the guide bar.

A new type of guide bars has therefore been developed where an adhesive material bound the layers. The guide bar normally comprises three layers. Layer one and three constitutes the outer sides of the guide bar. Between theses two layers is an intermediate layer of a material with lower density placed to reduce the weight of the guide bar. An adhesive material cured under pressure at a high temperature so that the bounding gets maximum strength bound the tree layers.

Guide bars of the described new type have higher torsional and bending stiffness compared to known guide bars. The guide bar also has lower weigh than known guide bars. The higher stiffness and lower weight improves the performance of the chain saw and reduces the loads that the operator is exposed to.

Guide bars normally comprises three different layers. Each guide bar will consequently comprise two layers of adhesive material to bind the different layers together. If the adhesive material is applied between the flat surfaces that will be bounded together is it difficult to get a layer of adhesive material with a constant and optimal thickness. If the thickness of the layer of adhesive materials not is the optional one will the strength of the bounding be effected in a negative way. Another problem is that the width of the groove that is extending around the guide bar will alternate and therefore not meet the requirements from the saw chain. This may cause additional sideways movements in the saw chain if the width is to big, or that the saw chain gets caught in the groove if the width is too small. Increasing movements sideways and friction also increases the wear on the guide bar and the saw chain.

The claimed invention solves the described problem by providing one of the surfaces that will be in contact with each other with protruding parts with a predetermined heights placed on the surface. The height of the protruding parts generates a slot between the surfaces. The thickness of this slot equals the height of the protruding parts and the thickness of the adhesive layer is therefor controlled by the height of the protruding parts so that the thickness of the adhesive layer is optimal for maximum strength of the bounding.

If the protruding parts are placed on both sides of the intermediate layer is it only necessary to provide the intermediate layer with protruding parts. The protruding parts are manufactured in different ways depending on the material in the intermediate layer. If the intermediate layer is made of aluminium is hobbing or embossing a suitable method for manufacturing while other materials requires methods like for example casting in a mould.

In order not to reduce the strength of the sides of the groove are the protruding parts placed so that they not will effect the bounding in the area close to the bottom of the groove. This means that the protruding parts are placed at a distance from the edge of the intermediate layer.

The protruding parts could be shaped in different ways. If the curing of the adhesive material is to take place under a high pressure is the area of the protruding parts preferably larger so that the layer that will align the protruding parts will rest in a stable way. One preferred embodiment of the protruding parts is a circular shape or another shape were the surface of the protruding part that will align the other layer is placed around the periphery of the geometrically shape. This embodiment will provide good support for the other layer without reducing the area where the adhesive is acting since adhesive may be applied inside the geometrical shape.

There is a big risk that layers bounded by an adhesive material that is cured under a high temperature and pressure will slip in relation to each other before the adhesive is cured. This problem is solved by applying a small amount of a quick-acting adhesive so that the layers are secured to each other and prevented from slipping during the curing of the adhesive. The adhesive material is applied in the predetermined pattern on the surface of the layer before the quick-acting adhesive finally is applied at some small areas on the surface of the layer. These small areas are preferably on top of the protruding parts. The layers are then put together and held in the right position in relation to each other by the quick-acting adhesive until the adhesive is cured at high temperature and pressure so that the bounding achieves the maximum strength.

A less complicated type of guide bar serves as a second embodiment of the claimed invention. This guide bar comprises only two layers. The edge that surrounds the layer is bent so that a groove is created when the two layers are put together. An adhesive material bound the layers. The described solution for controlling the thickness of the layer of adhesive material is adaptable also for this type of guide bar. One of the layers is provided with protruding parts while the surface of the other layer is flat so that a slot with constant width are generated between the layers when the layers are put together.

DETAILED DESCRIPTION OF THE INVENTION

Figure 3:
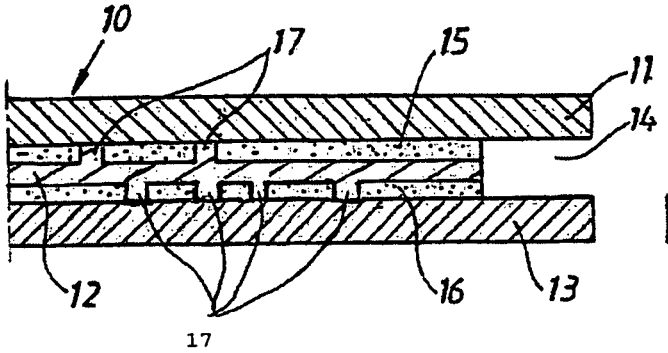
FIG. 3. Illustrates a cross section through a laminated guide bar comprising three layers. The intermediate layer is provided with a number of protruding parts on both sides to control the thickness of the adhesive layer.
Figure 1:
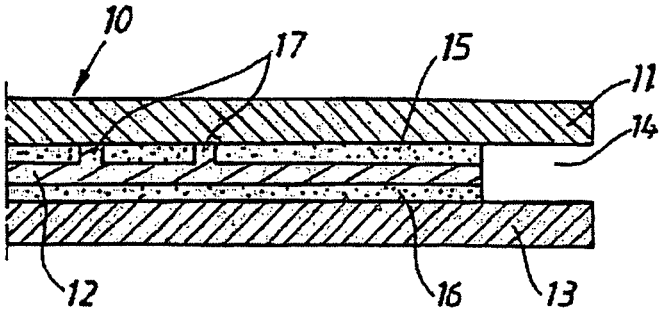
FIG. 1. Illustrates a cross section through a laminated guide bar comprising three layers. The intermediate layer is provided with a number of protruding parts to control the thickness of the adhesive layer.
Figure 2:
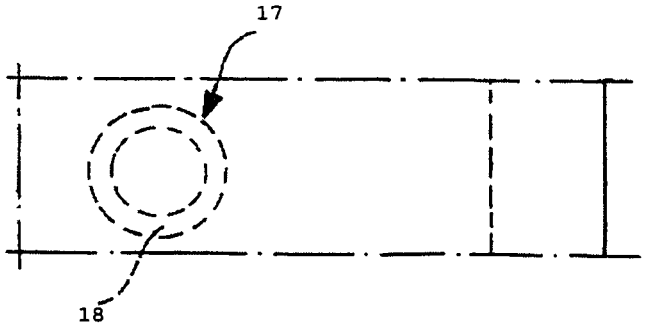
FIG. 2. Illustrates a side view of a section of a laminated guide bar. The protruding parts are shaped like circles so that the layers will align each other in a stable way without reducing the strength of the bounding.

A guide bar 10 comprises three layers 11, 12, 13. The first 11 and the third 13 layer are identically shaped while the intermediate layer 12 is shorter and have less width. When the three layers 11, 12, 13 are put together is a groove 14 defined around the guide bar 10 because of the smaller intermediate layer 12. The groove 14 is used for a not illustrated saw chain.

The guide bar 10 includes three different layers 11, 12, 13 that are bounded together by two layers 15, 16 of adhesive material that is acting on almost the entire surfaces that are in contact with each other.

The intermediate layer 12 is provided with several protruding parts 17. The protruding parts 17 generate a slot between the layers when the layers are put together. The protruding parts 17 controls the width of the slot and consequently the thickness of the adhesive layer so that the two adhesive bounding will achieve maximum strength. A constant and exact width of the slot is also important to ensure that the groove 14 will have the correct width for the saw chain so it will slide as easy as possible.

The protruding parts 17 could be shaped in different ways like for example a circle a triangle, a rectangle or a knob. The protruding parts 17 are placed on either of the surfaces that will be in contact with each other. A practical solution that is easy to manufacture is to place all protruding parts 17 on the two surfaces of the intermediate layer 12. This means that only one layer needs to be manufactured with protruding parts 17.

On top of the protruding parts 17 is a top-surface 18. The area of the top-surface is preferably kept small to not reduce the area of the surface where the adhesive is acting since that will reduce the strength of the bounding. One prefered embodiment of the protruding parts 17 are a geometrical shape were the top-surface 18 is placed around the periphery of the geometrical shape. This solution also have the advantage that the layer that will align the protruding parts 17 will rest on the protruding parts 17 in a stable way when the guide bar 10 is cured under pressure.

The protruding parts 17 are preferably spread out over the entire surfaces of the intermediate layer 12. The protruding parts 17 should however not be placed close to the bottom of the groove 14 that is extending around the guide bar 10 in order to not reduce the bounding strength in that area. The bounding must be as strong as possible because of the high loads that the sides of the groove 14 are exposed to from the saw chain during use.

The protruding parts 17 are placed so that there is a big area generated for supporting the aligning layer. This means that the protruding parts 17 should be spread over the surface so that a two dimensional surface that will provide a good and stable support for the aligning layer is created. This two dimensional surface will ensure that a high pressure can be applied on the guide bar 10 without reducing the bounding strength.

If a quick-acting adhesive is used to keep the layers in the right position in relation to each other until the adhesive is cured is the quick-acting adhesive preferable applied to the top-surfaces 18 of the protruding parts 17. The use of the top-surfaces 18 for the quick-acting adhesive means no reduction of the surface where the adhesive is acting.

The invention claimed is:

1. A guide bar (10) for a chain saw comprising at least three layers (11, 12, 13) that are bound by adhesive material (15, 16), characterised in that at least one of the surfaces of one of the layers is provided with several protruding parts (17) that are integral to that one layer and that the protruding parts do not intermesh with the other layers and that the protruding parts define a slot on the one layer for the adhesive material when the layers are put together, the three layers (11, 12, 13) provide a chain groove (14) having a width to receive a chain, a first (12) of the layers is intermediate the other two layers (11, 13) and defines a width of the chain groove, a second (11) of the layers is flat on an inner face to bound one side of the chain groove width defined by the first layer, and a third (13) of the layers is flat on an inner face to bound another side of the chain groove width defined by the first layer.

2. The guide bar according to claim 1, characterised in that the height of the protruding parts (17) defines the width of the slot and no single layer extends a complete width of the guide bar.

3. The guide bar according to claim 1, characterised in that the protruding parts (17) are shaped as the contours of geometrical shapes in order to reduce the area of the protruding parts (17).

4. The guide bar according to claim 1, characterised in that the protruding parts (17) are placed on the intermediate layer (12).

5. The guide bar according to claim 4, characterised in that the intermediate layer (12) is provided with protruding parts (17) on both sides of the intermediate layer (12).

6. The guide bar according to claim 4, characterised in that the protruding parts (17) on the intermediate layer (12) is manufactured by hobbing, embossing or casting in a mould.

7. The guide bar according to claim 1, characterised in that when the layers are put together the only material within the slot is adhesive material.

8. The guide bar according to claim 1, characterised in that the two layers that bound the sides of the chain groove width have surfaces that provide outside surfaces of the guide bar, and the several protruding parts, the slot and the adhesive material are within the interior of the guide bar.

9. The guide bar according to claim 1, characterised in that the protruding parts (17) do not intermesh with another of the layers and no single layer extends a complete width of the guide bar.

* * * * *